US005671916A

United States Patent [19]

Kaneko

[11] Patent Number: 5,671,916

[45] Date of Patent: Sep. 30, 1997

[54] AUTOMATIC SHEET LOADER

[75] Inventor: Yutaka Kaneko, Tokyo, Japan

[73] Assignee: Tetra Laval Holdings & Finance, S.A., Switzerland

[21] Appl. No.: 535,289

[22] PCT Filed: Jun. 23, 1994

[86] PCT No.: PCT/JP94/01003

§ 371 Date: Nov. 2, 1995

§ 102(e) Date: Nov. 2, 1995

[87] PCT Pub. No.: WO95/00396

PCT Pub. Date: May 1, 1995

[30] Foreign Application Priority Data

Jun. 23, 1993 [JP] Japan ..... 5-152349

[51] Int. Cl.[6] ..... B65H 3/08; B65H 1/26

[52] U.S. Cl. ..... 271/99; 271/30.1; 271/157; 414/794; 414/795.8; 198/409; 198/604; 198/468.6

[58] Field of Search ..... 271/157–159, 271/147, 162, 99, 30.1, 31; 198/409, 604, 468.6; 414/795.8, 794, 794.3

[56] References Cited

U.S. PATENT DOCUMENTS

| | | | |
|---|---|---|---|
| 3,591,018 | 7/1971 | Nalbach | 414/795.8 X |
| 4,343,392 | 8/1982 | Ellis et al. | 198/468.6 |
| 4,618,054 | 10/1986 | Muller | 198/409 |
| 5,275,527 | 1/1994 | Turra et al. | 414/795.8 |
| 5,304,030 | 4/1994 | Neri | 198/409 X |
| 5,435,432 | 7/1995 | Tacchi et al. | 198/409 |

*Primary Examiner*—Boris Milef

*Attorney, Agent, or Firm*—Lorusso & Loud

[57] ABSTRACT

An automatic sheet loader for automatically transferring sheets to a cardboard packer. The sheet loader includes at least a pair of chains disposed between upper sprockets and lower sprockets so that the pair of chains face each other to form a sheet transfer path therebetween, brackets mounted on the chains at predetermined intervals and projecting toward the sheet transfer path for supporting a group of sheets from both sides thereof, and a drive motor for driving the chains so as to move the brackets along the sheet transfer path for transferring the group of sheets. When the dimension of each packaging container, the number of packaging containers in each group, or the manner of packaging is changed, a different type of sheet is set. Since each group of sheets is moved and transferred from the upper side to the lower side by the chains, it is easy to distinguish the new group of sheets from the previous group of sheets during the exchange operation.

5 Claims, 14 Drawing Sheets

AUTOMATIC SHEET LOADER

TECHNICAL FIELD

The present invention relates to an automatic sheet loader.

BACKGROUND ART

Conventionally, packaging containers which are unloaded from a filling machine after being filled with a liquid food or the like are transferred to a cardboard packer in which a predetermined number of packaging containers are stacked in a packing pattern and placed in a case made of a sheet.

The case is produced by folding a blank sheet formed by cutting a corrugated cardboard sheet or the like into a predetermined shape by a die cutter. The shape of the blank sheet varies in accordance with the dimension and number of packaging containers to be placed in the case, and the manner of packaging. In the case of a tray sheet, the sheet has a shape to cover two opposing side surfaces of a group of packaging containers which have been stacked on the sheet in a predetermined packing pattern. In the case of a carrier sheet, the sheet has a shape to form grips for transportation as well as to cover two opposing side surfaces of a group of packaging containers which have been stacked on the sheet in a predetermined packing pattern. In the case of a wrap-around sheet, the sheet has a shape to wholly cover a group of packaging containers which have been stacked on the sheet in a predetermined packing pattern.

The cardboard packer is provided with a magazine slanted at about 45°. For example, 50 sheets are bundled to form a group of sheets, and the group of sheets is manually set into the magazine. The cardboard packer is also provided with a suction device which takes out a single sheet at a time from the magazine by a suction force, and places it on a table of the machine. Subsequently, a group of packaging containers which have been conveyed by a conveyer is placed on the sheet, and is wrapped by folding the sheet by a folding machine.

Since the group of sheets is placed in the magazine which is inclined at 45°, the load imposed on the bottom sheet can be reduced, thereby facilitating the taking out of the sheets by the suction device.

However, the conventional cardboard packer requires a cumbersome work because the group of sheets must be manually set into the magazine.

Moreover, in the case where the group of sheets set into the magazine is replaced with a different group of sheets because of changes in the dimension or number of packaging containers in the group or the manner of packaging, it is necessary to watch the operation to prevent the previous group of sheets and the new group of sheets from being used in mixture.

An object of the present invention is to solve the problems involved in the conventional cardboard packer, and to provide an automatic sheet loader which can automatically set a group of sheets into a cardboard packer, and can easily replace the group of sheets when the dimension or number of packaging containers to be packed, or the manner of packaging is changed.

DISCLOSURE OF THE INVENTION

To achieve the above-described object, an automatic sheet loader according to the present invention is provided with a sheet transfer path along which a group of sheets is transferred, a swinger which is pivotably supported at the lowermost end of the sheet transfer path, and which receives the group of sheets at a horizontal position and then pivots toward a magazine section to take an oblique position, drive means for swinging the swinger, a magazine which is disposed slanted and into which the group of sheets dropped from the swinger is set, and a suction device for taking out each sheet of the group from the magazine by a suction force.

The swinger has a stopper for temporarily holding the group of sheets.

In another aspect of the present invention, the stopper is swingably supported by the swinger via a shaft, and takes a hold position for holding a group of sheets and a release position for releasing and dropping the group of sheets.

In still another aspect of the present invention, the stopper is provided with a pair of taper keys having opposing slant surfaces. The stopper is fixed on the shaft by moving the taper keys relative to each other.

In yet another aspect of the present invention, the automatic sheet loader is provided with sheet transfer means, disposed in the sheet transfer path, which includes at least a pair of chains disposed between upper sprockets and lower sprockets so that the pair of chains face each other to form a sheet transfer path therebetween, brackets mounted on the chains at predetermined intervals and projecting toward the sheet transfer path for supporting a group of sheets from both sides thereof, and drive means for running the chains so as to move the brackets along the sheet transfer path for transferring the group of sheets.

In yet another aspect of the present invention, the automatic sheet loader is provided with a width adjusting mechanism for moving the chains in accordance with the dimension of the group of sheets.

As described above, the automatic sheet loader according to the present invention is provided with a sheet transfer path along which a group of sheets is transferred, a swinger which is pivotably supported at the lowermost end of the sheet transfer path, and which receives a group of sheets at a horizontal position and then pivots toward a magazine section to take an oblique position, drive means for swinging the swinger, a magazine which is disposed slanted and into which the group of sheets dropped from the swinger is set, and a suction device for taking out each sheet of the group from the magazine by a suction force.

The group of sheets transferred along the sheet transfer path is received by the swinger at the lowermost end of the sheet transfer path. The swinger has a stopper for holding and releasing the group of sheets. The swinger supports the group of sheets transferred along the sheet transfer path.

Subsequently, the swinger is swung to the oblique position at which the group of sheets is released from the swinger and is set into the magazine. The suction device takes out one sheet at a time from the magazine by a suction force and puts it on the table of the machine.

In another aspect of the present invention, the stopper is swingably supported by the swinger via a shaft, and takes a hold position for holding a group of sheets and a release position for releasing and dropping the group of sheets. Accordingly, the group of sheets is received when the stopper is located at the hold position and is released when the stopper is moved to the release position.

In still another aspect of the present invention, the stopper is provided with a pair of taper keys having opposing slant surfaces. When the taper keys are moved relative to each other, the stopper is fixed to the shaft due to a wedge effect.

In yet another aspect of the present invention, the automatic sheet loader includes at least a pair of chains disposed between upper sprockets and lower sprockets so that the pair of chains face each other to form a sheet transfer path therebetween, brackets mounted on the chains at predetermined intervals and projecting toward the sheet transfer path for supporting a group of sheets from both sides thereof, and drive means for running the chains so as to move the brackets along the sheet transfer path for transferring the group of sheets.

When the operation of the drive means is started, the chains are run so that the group of sheets held between a pair of brackets is transferred from an upper side to a lower side. The brackets are turned at the lowermost end of the sheet transfer path to release the group of sheets.

BEST MODE FOR CARRYING OUT THE INVENTION

An embodiment of the present invention will now be described with reference to the accompanying drawings.

Figure 1:
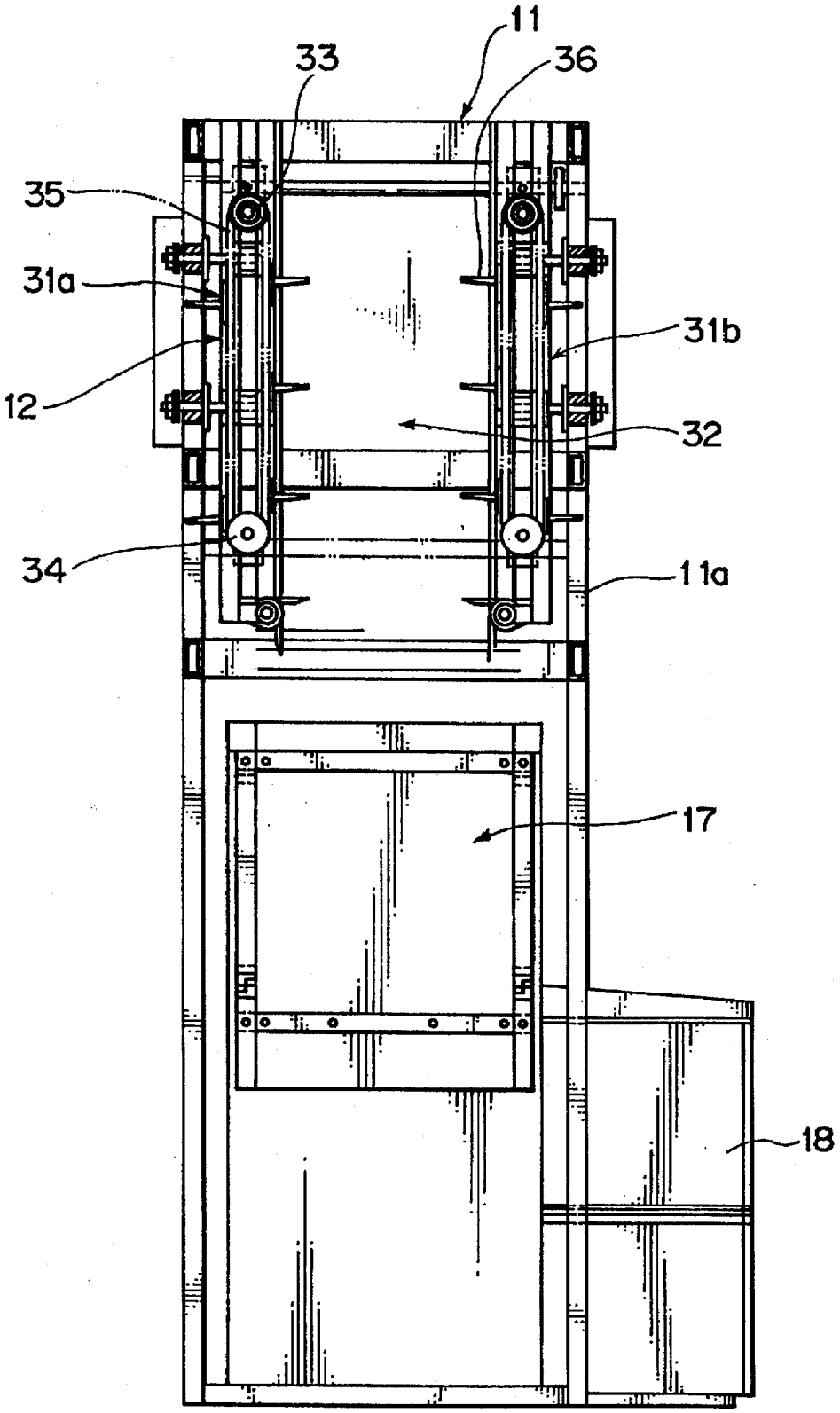
FIG. 1 is a front view of an automatic sheet loader showing an embodiment of the present invention.
Figure 2:
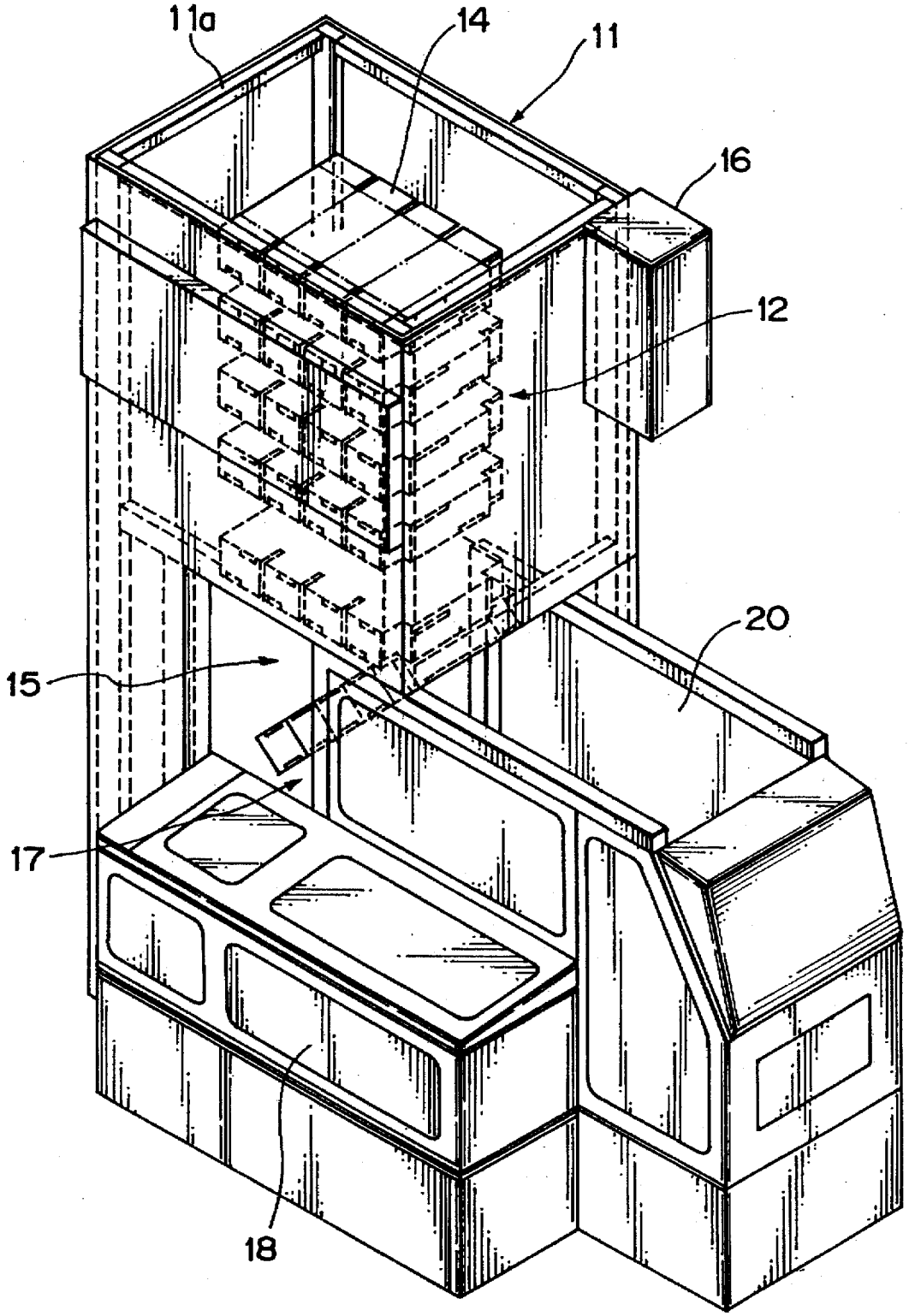
FIG. 2 is a perspective view of the automatic sheet loader showing the embodiment of the present invention.

In FIG. 2, numeral 11 denotes an automatic sheet loader provided with a lifter 12. In the lifter 12, a group of sheets 14 formed by bundling a predetermined number of sheets is transferred downwardly. The group of sheets 14 is transferred in the lifter 12 while being horizontally supported, and reaches a swinger 15 disposed at the lowermost portion of the lifter 12.

The swinger 15 is swingably supported to take a horizontal position for horizontally supporting the group of sheets 14 and an oblique position for supporting the group of sheets 14 slanted at about 45°. When the swinger 15 located at the horizontal position receives a group of sheets 4 which have been transferred, the swinger 15 swings toward the magazine section 17, and is placed at the oblique position to set the group of sheets 14 into an unillustrated magazine.

On the other hand, a group of packaging containers conveyed by an unillustrated conveyer is supplied to an infeed section 18, and is pushed by an unillustrated pusher disposed at a proper position in the infeed section 18 so that a predetermined number of packaging containers are stacked in a predetermined pattern.

In a cardboard packer 20, a suction device takes out one sheet at a time from the magazine by a suction force, and places it on a table of the machine. The sheet is then folded by an unillustrated folding device to wrap the group of packaging containers. Numeral 11*a* denotes a frame.

Figure 3:
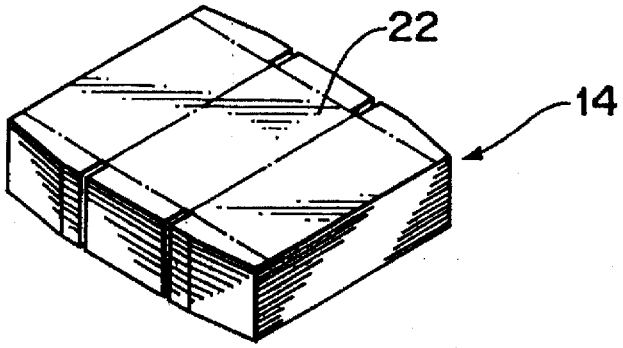
FIG. 3 is a perspective view of a group of tray sheets.
Figure 4:
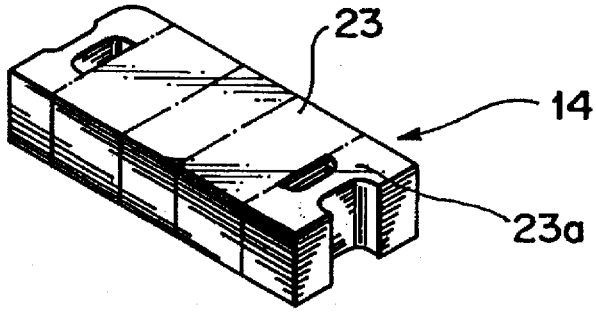
FIG. 4 is a perspective view of a group of carrier sheets.
Figure 5:
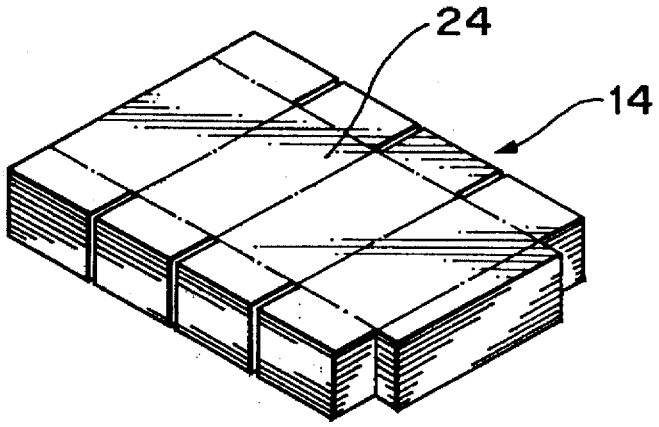
FIG. 5 is a perspective view of a group of wrap-around sheets.
Figure 6:
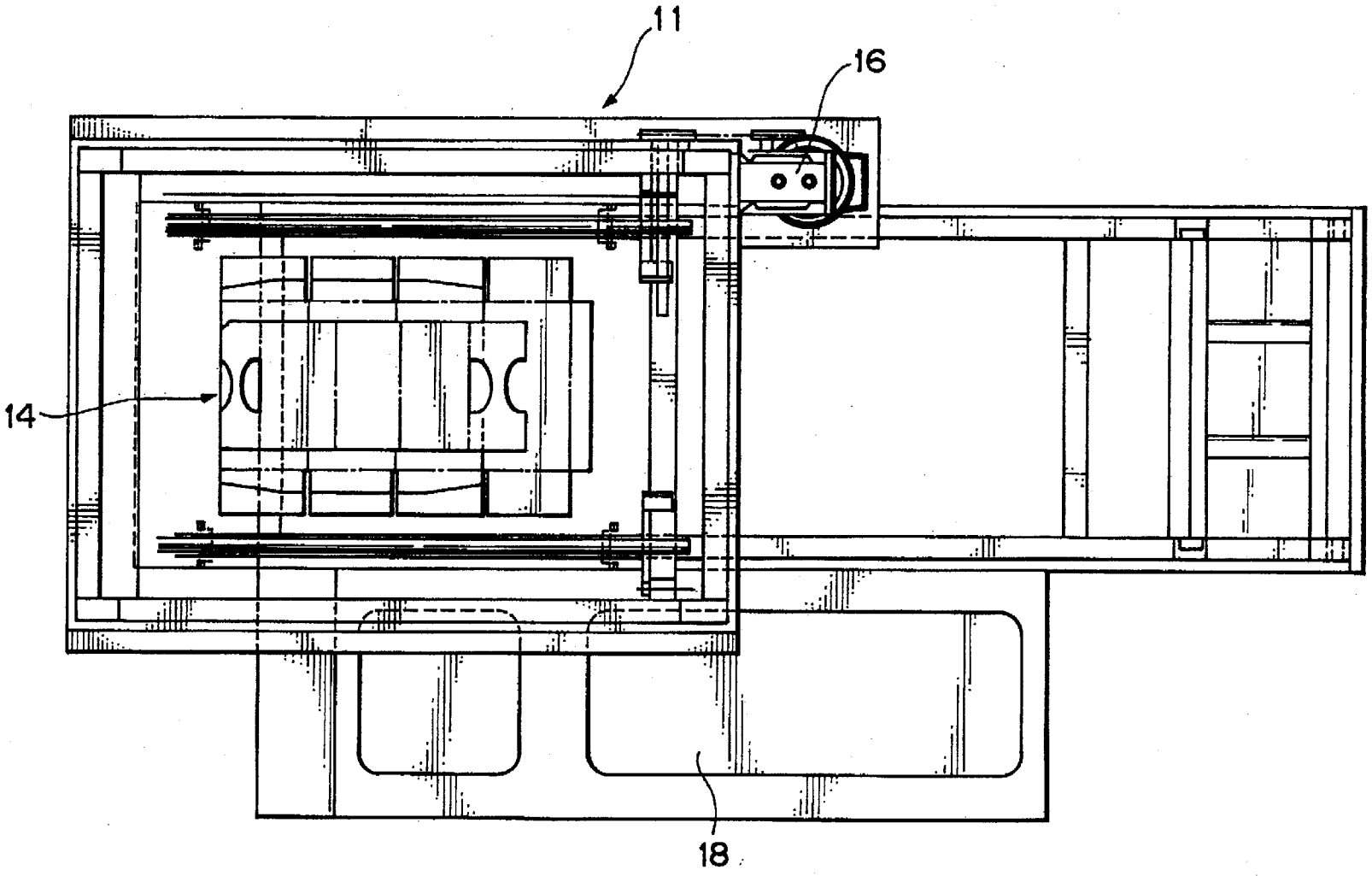
FIG. 6 is a plan view of the automatic sheet loader showing the embodiment of the present invention.
Figure 7:
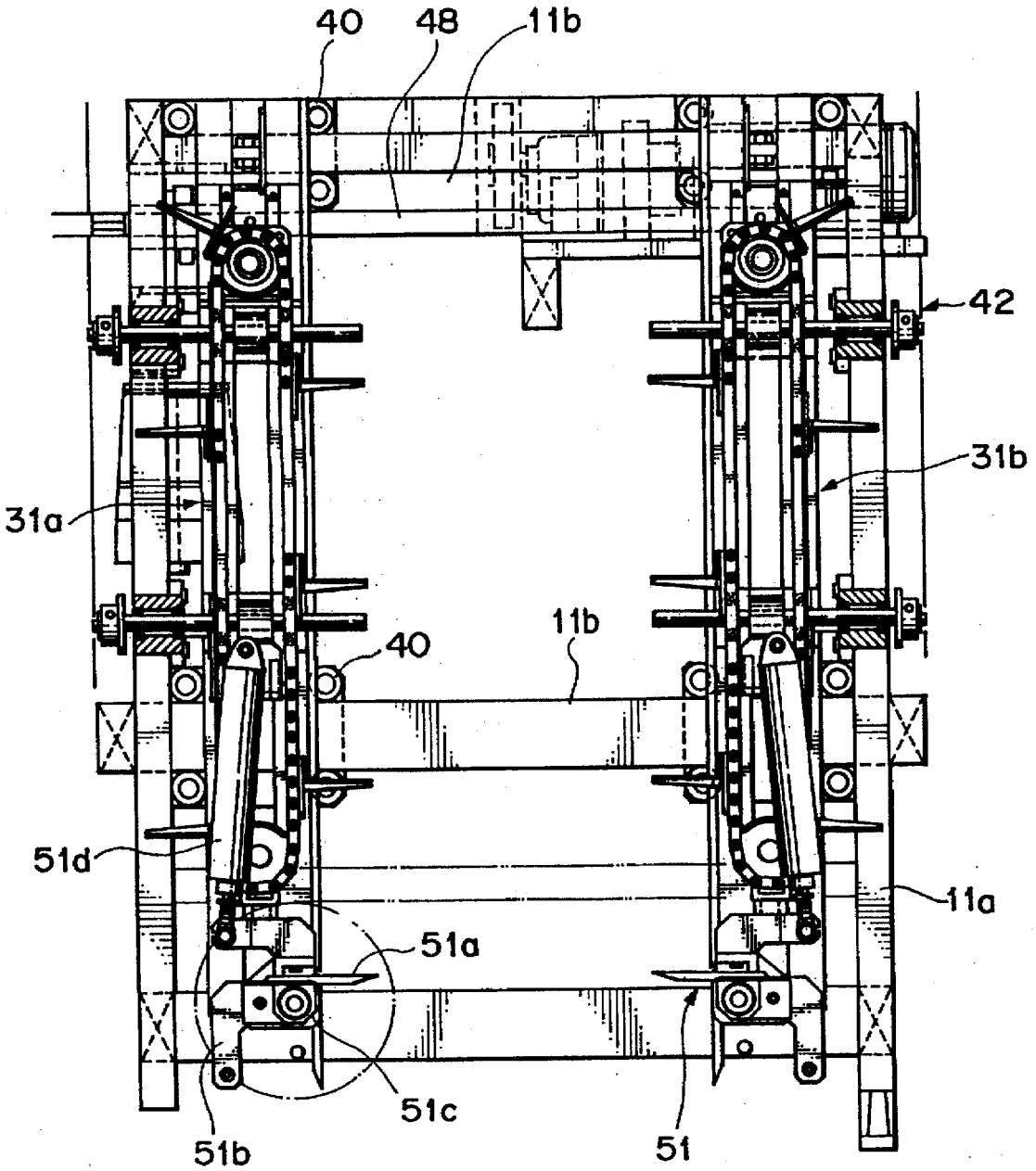
FIG. 7 is a front view of a lifter used in the embodiment of the present invention.

The group of sheets 14 is formed by bundling 50 sheets, for example. The shape of each sheet varies in accordance with the dimension and number of packaging containers to be stacked, and the manner of packaging. That is, in the case of tray sheets 22 shown in FIG. 3, each sheet has a shape to cover two opposing side surfaces of a group of packaging containers which have been stacked on the sheet 22 in a predetermined packing pattern. In the case of carrier sheets 23 shown in FIG. 4, each sheet has a shape to form grips 23*a* for transportation as well as to cover two opposing side surfaces of a group of packaging containers which have been stacked on the sheet 23 in a predetermined packing pattern. In the case of wrap-around sheets 24 shown in FIG. 5, each sheet has a shape to wholly cover a group of packaging containers which have been stacked on the sheet 24 in a predetermined packing pattern.

Next, the lifter 12 will be described.

As shown in FIGS. 1 and 6–9, the lifter 12 is disposed above the magazine section 17 and the infeed section 18 of the automatic sheet loader 11. The lifter 12 is composed of a pair of chain units 31*a* and 31*b* which form a sheet transfer path 32 therebetween.

The chain units 31*a* and 31*b* are disposed in the frame 11*a* of the automatic sheet loader 11 parallel with and facing each other. A pair of guide bars 11*b* are attached to the frame 11*a* at predetermined upper and lower positions, respectively. The chain units 31*a* and 31*b* have guide rollers 40 which move along the guide bars 11*b* while rotating.

Figure 9:
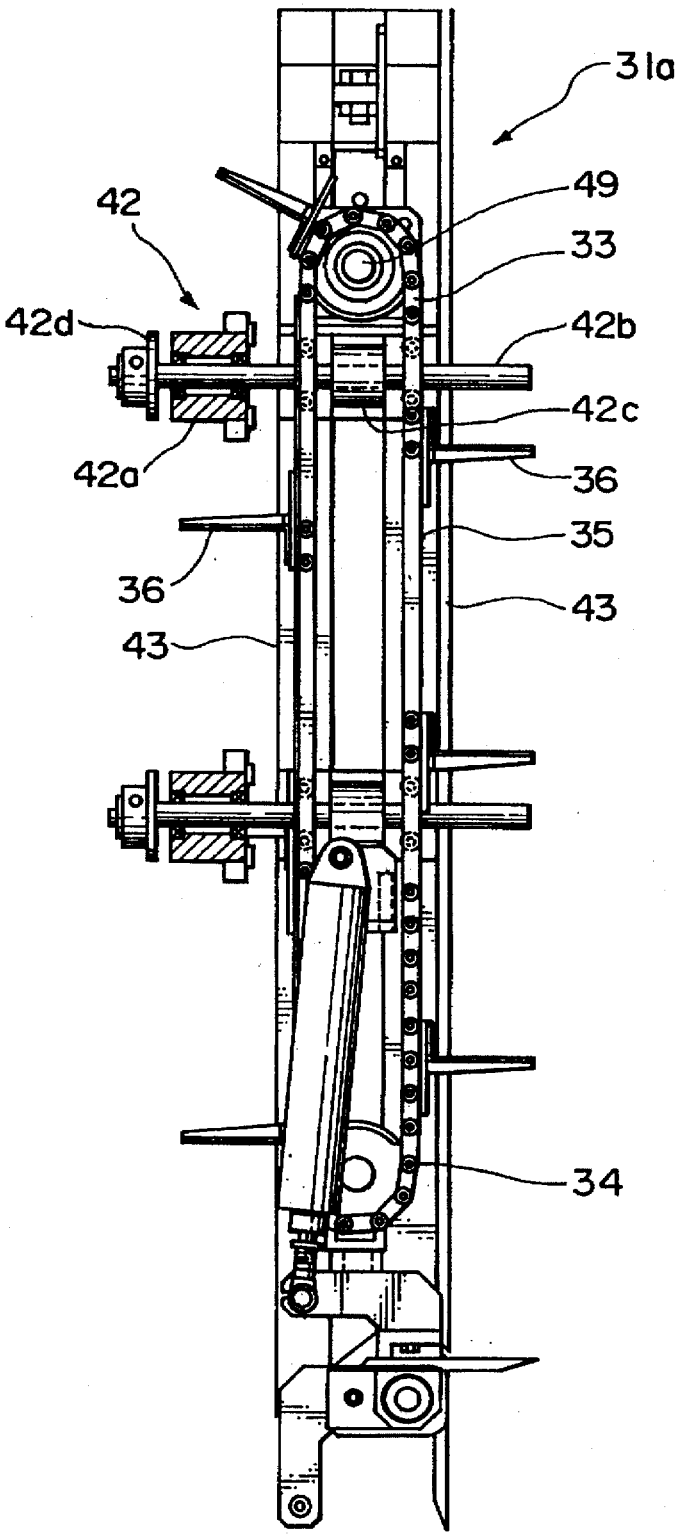
FIG. 9 is a detailed view of a chain unit used in the embodiment of the present invention.
Figure 10:
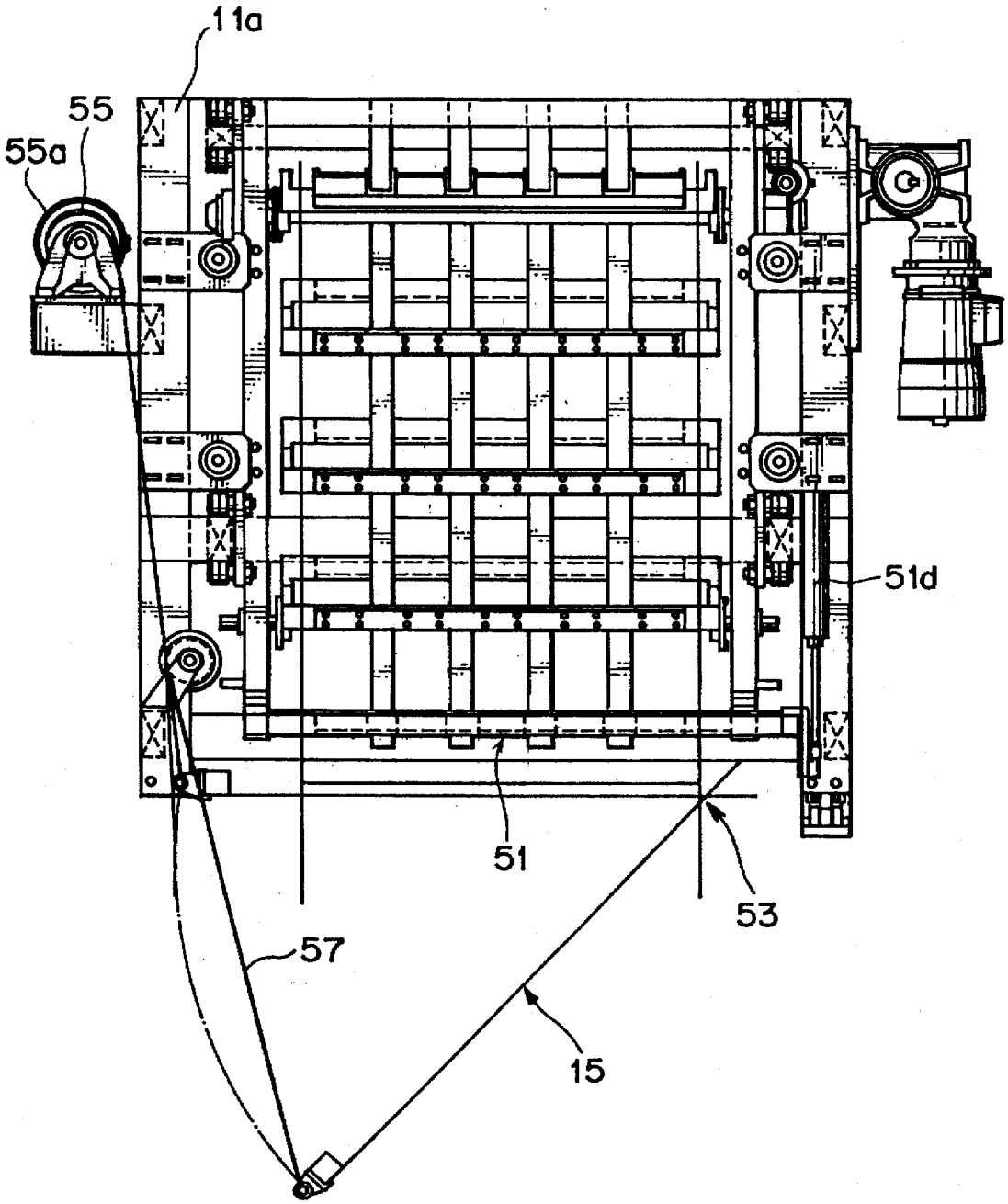
FIG. 10 is a side view of the lifter used in the embodiment of the present invention.
Figure 11:
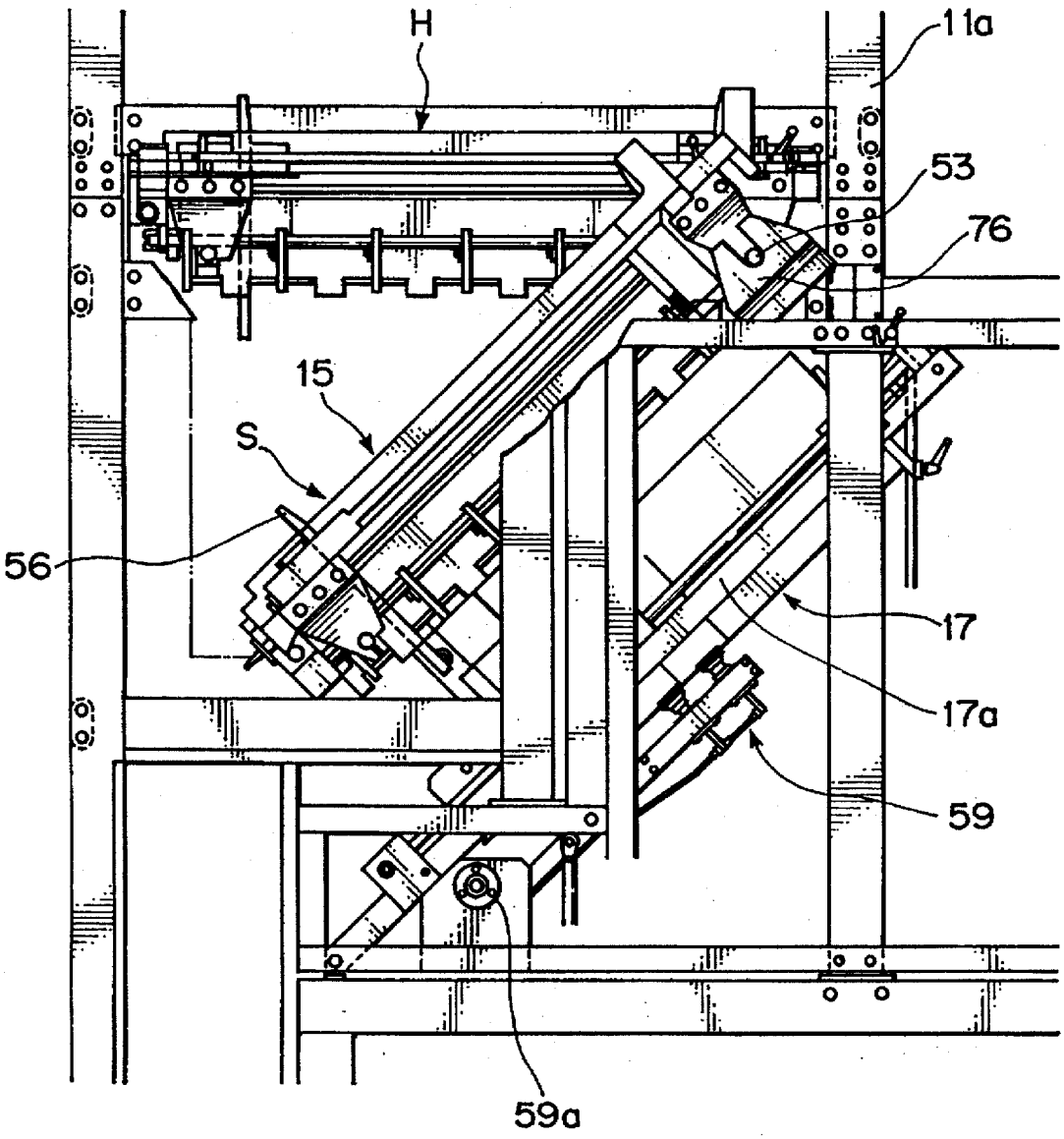
FIG. 11 is a detailed view of a main portion of a swinger used in the embodiment of the present invention.
Figure 12:
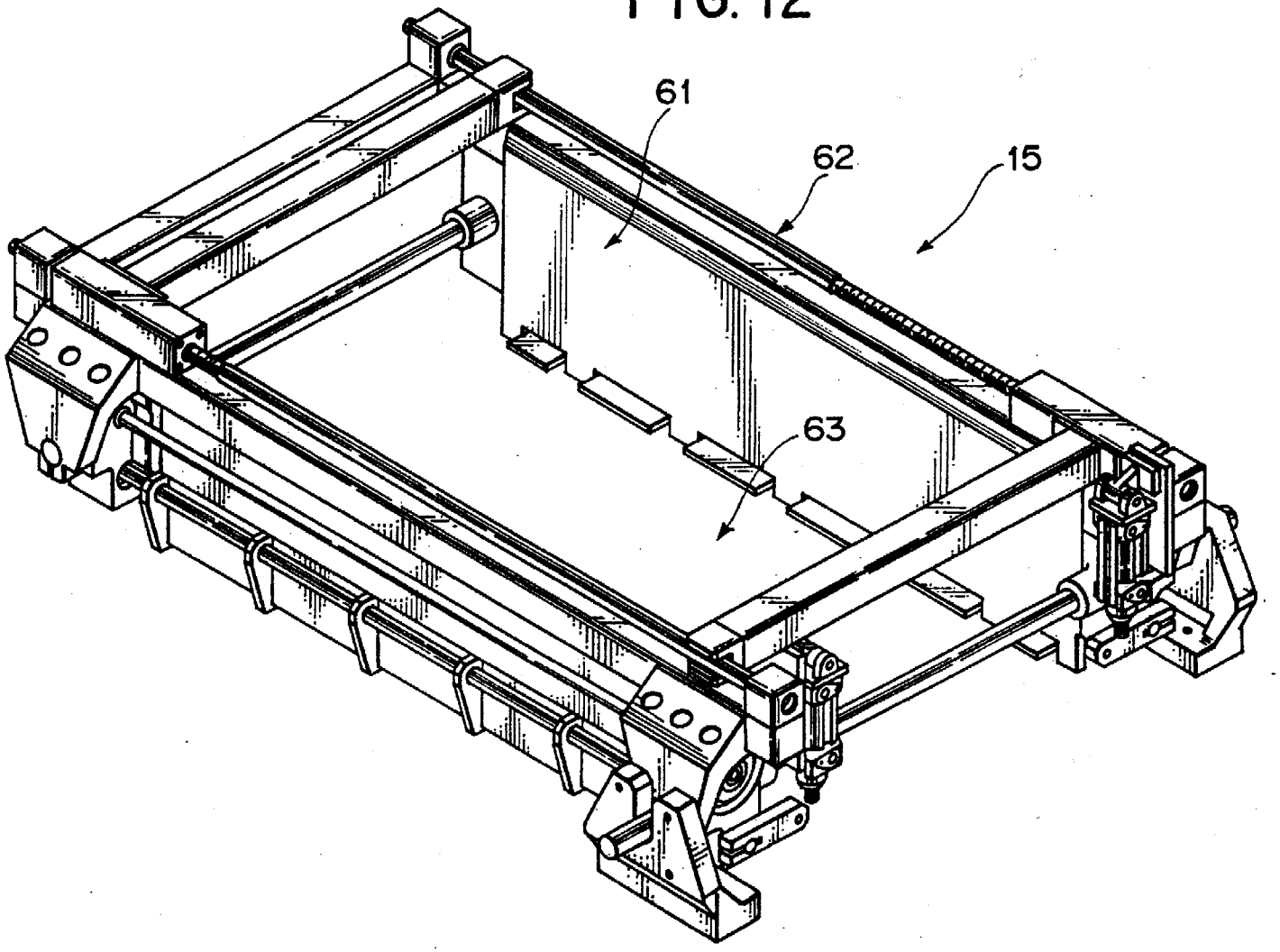
FIG. 12 is a perspective view of the swinger used in the embodiment of the present invention.

Also, width adjusting units 42 are provided for positioning the chain units 31*a* and 31*b* along the guide bar 11*b*. As shown in FIG. 9, each of the width adjusting units 42 is composed of a bearing 42*a* fixed on the frame 11*a*, a ball screw 42*b* rotatably supported by the bearing 42*a*, a ball nut 42*c* fixed between a pair of columns 43 of the chain units 31*a* and 31*b*, and a width adjusting sprocket 42*d* fixed to one end of the ball screw 42*b*. The width adjusting sprocket 42*d* is connected to an unillustrated width adjusting motor via an unillustrated chain. Accordingly, the chain units 31*a* and 31*b* can be moved in accordance with the dimension of the group of sheets 14 by driving the width adjusting motor which rotates the ball screw 42*b*.

Figure 8:
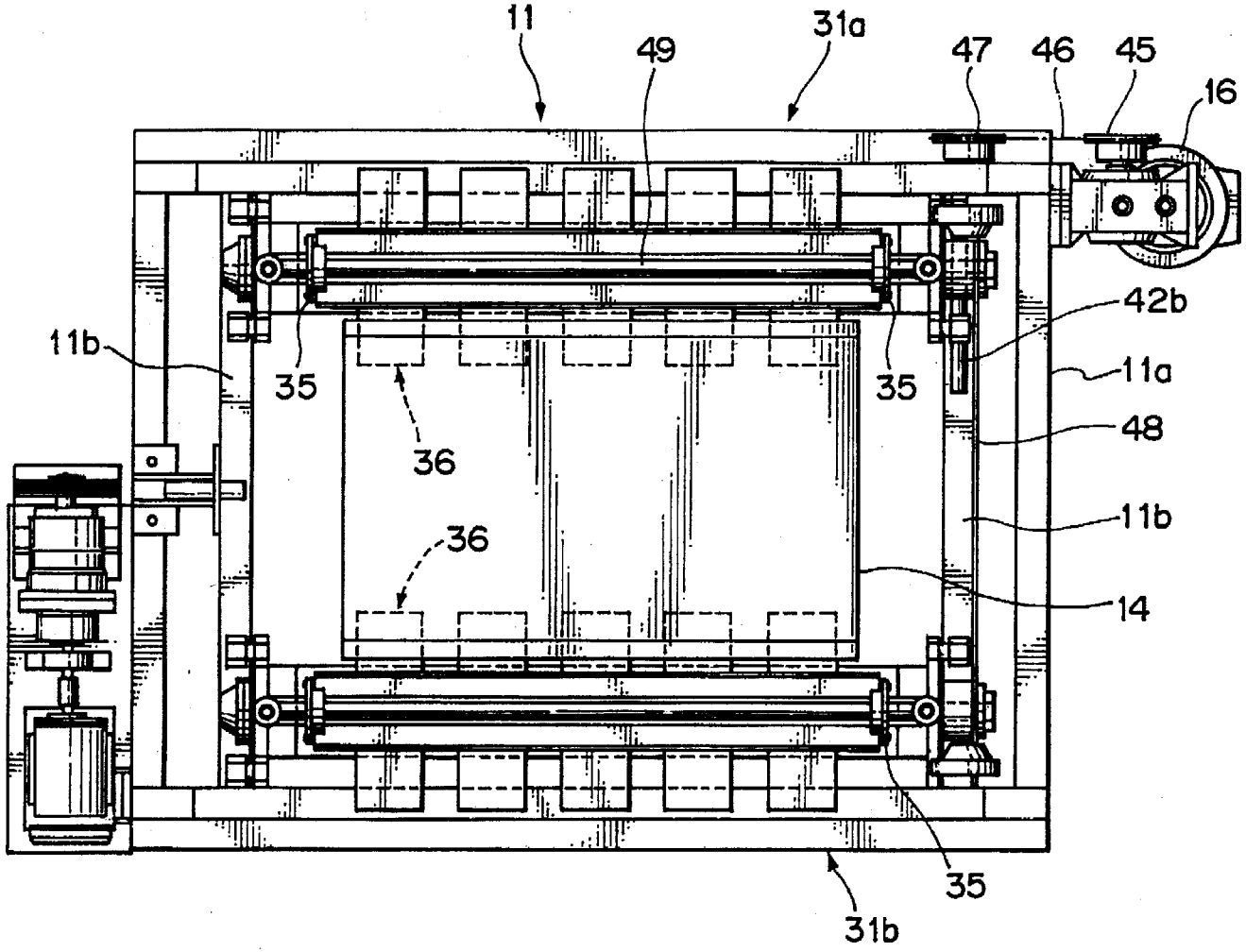
FIG. 8 is a plan view of the lifter used in the embodiment of the present invention.

As shown in FIG. 8, each of the chain units 31*a* and 31*b* is provided with a pair of chains 35 which are disposed to extend between driveside upper sprockets 33 and slave-side lower sprockets 34. Brackets 36 are fixed to the chains 35 at a predetermined intervals. Each pair of brackets 36 are fixed to the chains 35 of the chain units 31*a* and 31*b* at the same longitudinal position so that the brackets 36 are opposed to each other and project into the sheet transfer path 32, thereby supporting the group of sheets 14 from both sides thereof.

The chains 35 can be run by driving the lifter drive motor 16 which rotates the upper sprockets 33. In detail, rotation of the lifter drive motor 16 is transmitted to a lifter drive shaft 48 via a sprocket 45, a chain 46, and a sprocket 47. The rotation of the lifter drive shaft 48 is then transmitted to the sprocket shaft 49 via an unillustrated bevel gear so as to rotate the upper sprockets 33.

When the chains 35 are thus run, the brackets 36 downwardly move along the sheet transfer path 32, thereby moving the group of sheets 14 downward. When the brackets 36 reach a position at which the chains 35 engage the lower sprockets 34, the brackets 36 move outside along the lower sprockets 34 while turning, and then move upward. At this time, the group of sheets 14 supported by a pair of brackets 36 on the chains 35 of the chain units 31*a* and 31*b* falls from the brackets 36 because the pair of brackets simultaneously turn outside.

The group of sheets 14 is then supported by a shooter 51 disposed under the chain units 31*a* and 31*b*. The shooter 51 is composed of a pair of first stoppers 51*a* projecting toward the sheet transfer path 32 like the brackets 36, arms 51*b* which rotatably support the first stoppers 51*a*, and swing cylinders 51*d* for swinging the arms 51*b* about shafts 51*c*. Accordingly, the arms 51*b* are rotated by the swing cylinders 51*d* to bring the first stoppers 51*a* in a horizontal posture for supporting the group of sheets 14 and to bring the first stoppers 51*a* in a vertical posture for dropping the group of sheets 14 on the swinger 15 (see FIG. 2).

Next, the swinger 15 will be described with reference to FIGS. 10–16. In FIG. 15, section (a) shows the inner side of the second stopper while section (b) shows the outer side of the second stopper.

In these drawings, numeral 15 denotes a swinger which is supported for swing movement about a pivot 53. The swinger 15 takes a horizontal position H for horizontally supporting the group of sheets 14 (see FIG. 8) dropped from the shooter 51 and an oblique position S for supporting the group of sheets 14 in an inclined posture of about 45°. When the swinger 15 receives the group of sheets 14 dropped from the shooter 51 at the horizontal position H, the swinger 15 swings toward the magazine section 17, and assumes the oblique position S.

Also, a swinger drive motor 55 is disposed for swinging the swinger 15. The swinger drive motor 55 is fixed on the frame 11*a*, and rotates a take-up drum 55*a* in the forward and reverse directions. One end of a wire rope 57 is fixed to the take-up drum 55*a*, while the other end of the wire rope 57 is fixed to the forward end of the swinger 15. Accordingly, when the wire rope 57 is wound up, the swinger 15 is brought into the horizontal position H, and when the wire rope 57 is released, the swinger 15 is brought into the oblique position S.

A side guide 56 is provided at the forward end of the swinger 15 for preventing the group of sheets 14 from falling down during swing movement of the swinger 15.

After the swinger 15 has received the group of sheets 14 dropped from the shooter 51, the swinger 15 holds the group of sheets 14 until it has swung to be positioned at the magazine section 17. At the magazine section 17, the swinger 15 drops the group of sheets 14 to set them into the magazine 17*a*. The magazine 17*a* is mounted inclined at about 45° so that the group of sheets 14 dropped from the swinger 15 is held in a slanted state.

Moreover, a suction device 59 is arranged underneath the magazine 17*a* for swing movement about a shaft 59*a*. The suction device 59 takes out one sheet at a time from the magazine 17*a* by a suction force.

The swinger 15 is composed of a lower member 61 and an upper member 6Z which form a sheet group receiving space 63 therebetween for receiving a group of sheets 14.

Figure 13:
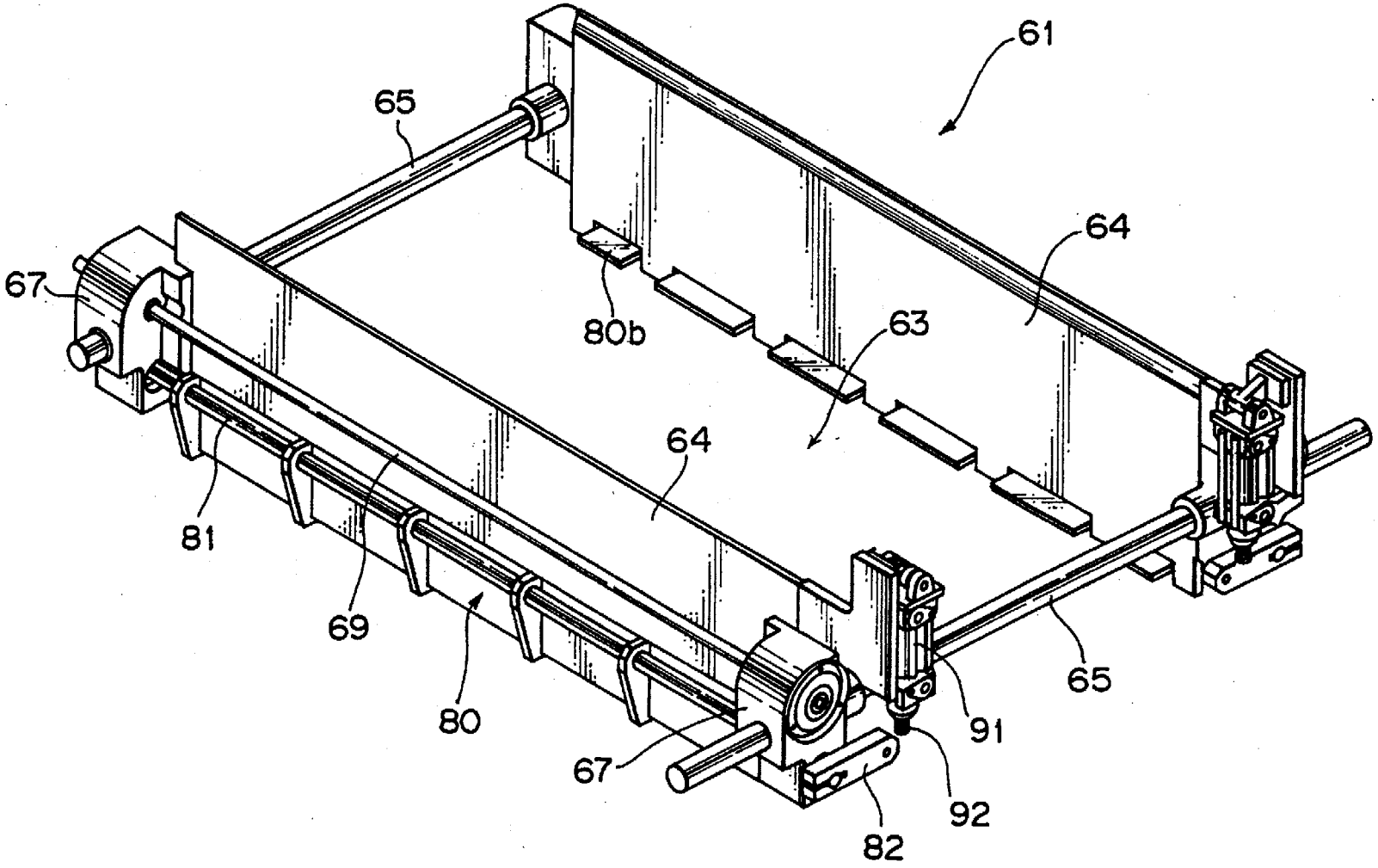
FIG. 13 is a perspective view of a lower member of the swinger used in the embodiment of the present invention.

As shown in FIG. 13, the lower member 61 has a pair of side plates 64 which are disposed in parallel and facing each other. Both ends of the side plates 64 are supported by the rods 65. The rods 65 penetrate support members 67 disposed at both ends of the side plates 64, and shafts 69 disposed along the side plates 64 also penetrate both the support members 67.

In each of the support members 67, a worm gear and a worm wheel (both not illustrated) are disposed so that when the shaft 69 is rotated by an unillustrated drive motor, the rods 65 are rotated. Since ball screw mechanisms are provided between the rods 65 and the support members 67, the side plates 64 can be moved along the rods 65 by rotating the rods 65. Accordingly, the distance between the side plates 64 can be changed in accordance with the width of the group of sheets 14.

Figure 14:
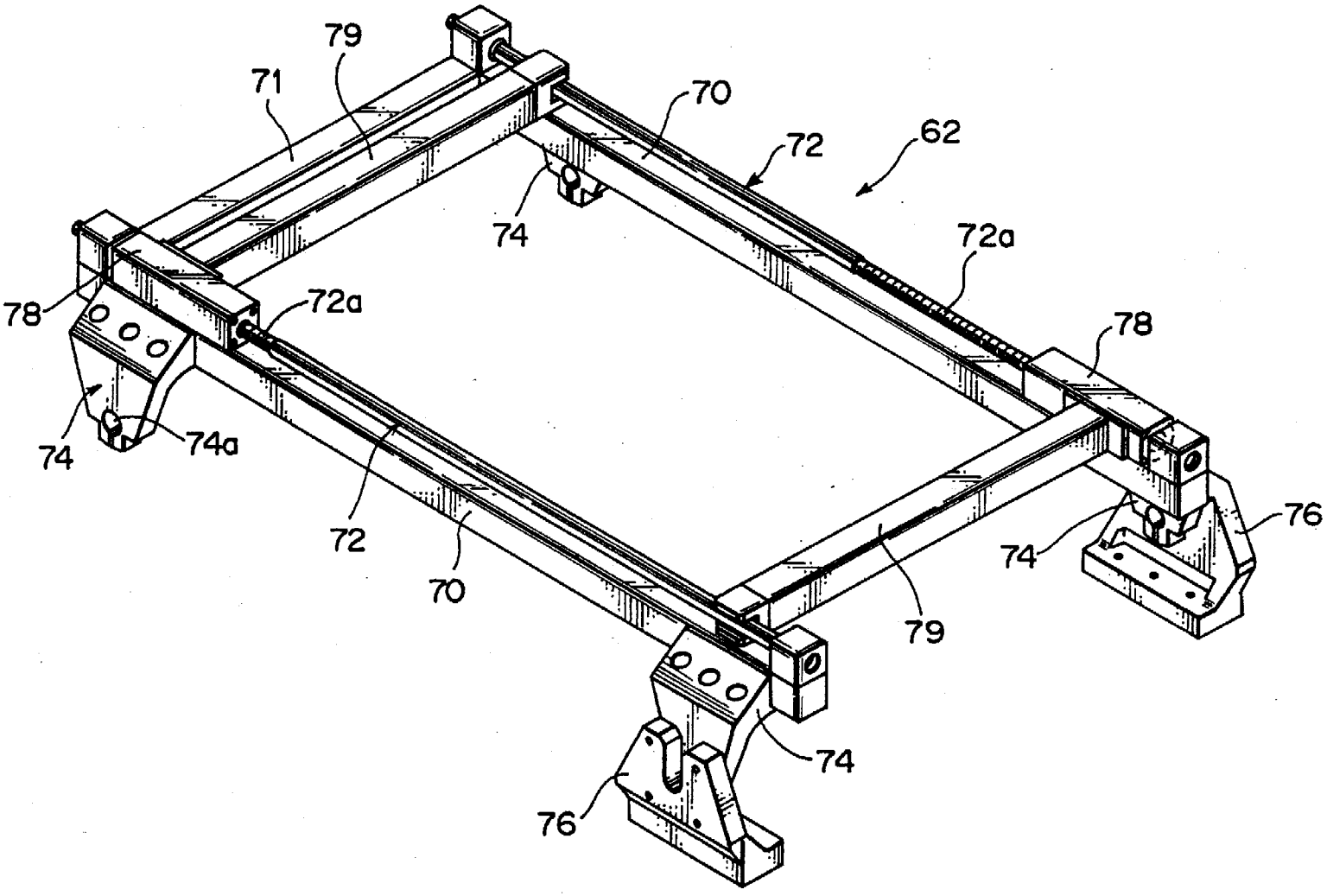
FIG. 14 is a perspective view of an upper member of the swinger used in the embodiment of the present invention.
Figures 15A, 15B:
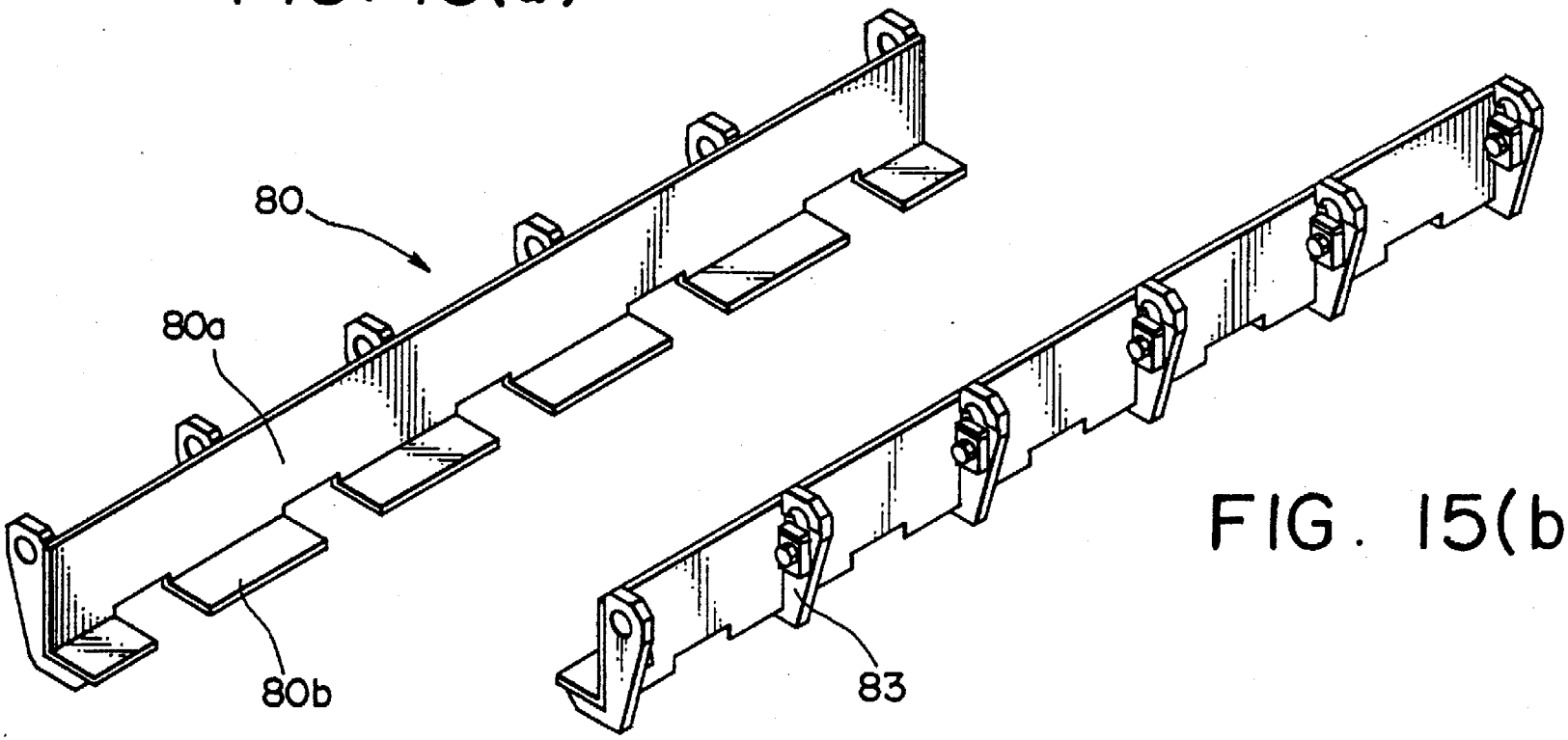
FIG. 15 shows perspective views of second stoppers used in the embodiment of the present invention.

As shown in FIG. 14, the upper member 62 has a pair of side bars 70 which are disposed in parallel with each other and face each other. One end of each side bar 70 is supported by a lateral bar 71. Fixing members 74 project from both ends of each side bar 70. The upper member 62 is assembled with the lower member 61 such that the support members 67 are covered by the fixing members 74. The lower member 61 and the upper member 62 are integrated with each other by inserting the rods 65 into the through holes 74*a* formed in the fixing members 74.

To form the pivot 53, support members 76 are attached to the frame 11*a* to support the rods 65 projecting from the fixing members 74. With this structure, the swinger 15 is swingably supported.

Moreover, side rods 72 are rotatably disposed on the side bars 70 in parallel with the side bars 70. A ball screw 72*a* is formed on one end of each side rod 72. Ball nuts 78 are also disposed to be engaged with the ball screws 72*a*. An adjusting bar 79 fixed to each of the ball nuts 78 is extended toward opposite one of the side rods 72 and is slidably engaged with the opposite side rod 72.

Accordingly, when the side rods 72 are rotated by an unillustrated drive motor, the ball screws 72*a* are rotated so that the adjusting bars 79 are moved. With this operation, the adjusting bars can be moved in accordance with the length of the group of sheets 14.

When the swinger 15 receives the group of sheets 14 dropped from the shooter 51, the swinger 15 swings toward the magazine section 17. During this swing movement, the swinger 15 holds the group of sheets 14. For this purpose, a second stopper 80 is provided at the lower end of each of the side plates 64. The second stopper 80 is fixed to a shaft 81, and is supported by the support members 67 via the shaft 81. Each second stopper 80 is positioned at a hold position for holding the group of sheets 14 and at a release position for releasing and dropping the group of sheets 14.

As shown in FIG. 15, each of the second stoppers 80 is composed of a side wall 80*a* extending in the longitudinal direction of the swinger 15, and projection members 80*b* formed at a plurality of positions along the lower edge of the side wall 80*a*. The projection members 80*b* extend perpendicularly with respect to the side wall 80*a*. When the second stoppers 80 are located at the hold positions, the projection members 80*b* are projected from the lower ends of the side plates 64 toward the inside of the sheet group receiving space 63. When the second stoppers 80 are located at the release positions, the projection members 80*b* are retracted to the outside of the side plates 64.

For this purpose, a lever 82 is fixed to one end of each shaft 81, and a cylinder 91 is disposed at one end of the corresponding side plate 64. When the piston rod 92 of the cylinder 91 is moved up and down, the lever 82 swings via an unillustrated linkage mechanism.

Figure 16:
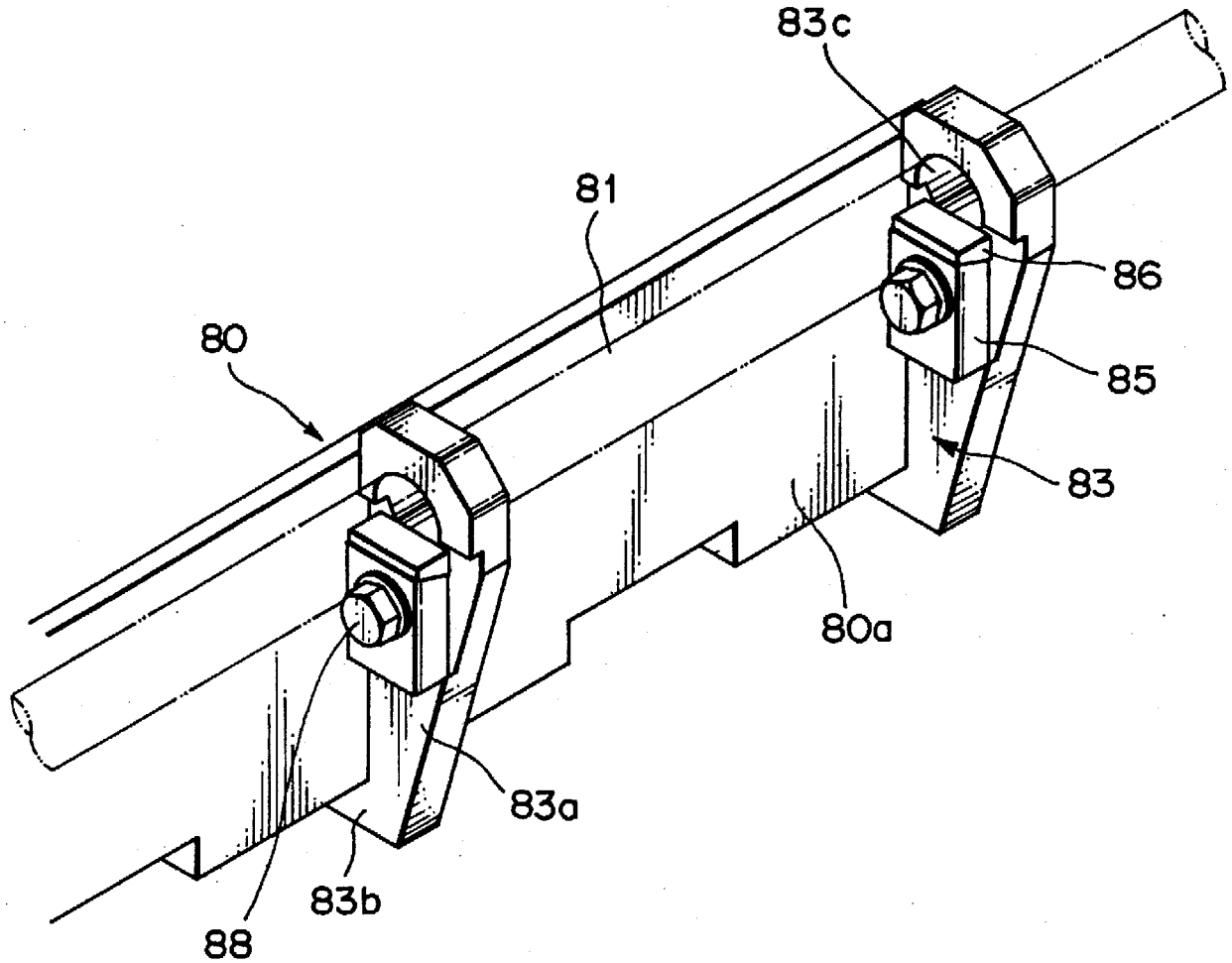
FIG. 16 is a perspective view of a main portion of the second stopper used in the embodiment of the present invention.

To fix the second stoppers 80 to the shafts 81, ear-shaped projections 83 are formed at the plurality of positions on the outer surface of each side wall 80*a*. As shown in FIG. 16, each projection 83 has a main portion 83*a*, and a support portion 83*b* which extends under the projection member 80*b*. A through hole 83*c* is formed in each projection 83 at a location corresponding to the shaft 81, and the shaft 81 penetrates the through hole 83*c*.

Moreover, first and second taper keys 85 and 86 are disposed on each main portion 83*a*, and the upper surface of the second taper key 86 is contacted with the lower surface of the shaft 81. The first and second taper keys 85 and 86 have opposing slant surfaces. Accordingly, when the relative position between the first and second taper keys 85 and 86 is varied by an adjusting bolt 88, the second taper key 86 is raised and pressed against the lower surface of the shaft 81. In this manner, each second stopper 80 can be fixed to the corresponding shaft 81 by a wedge effect of the first and second taper keys 85 and 86. The lower surface of each shaft 81 is cut away at positions corresponding to each second taper key 86.

Even if each projection 83 is made of a soft material such as aluminum, the durability can be increased because the force from each adjusting bolt 88 is small. Further, since the position of each adjusting bolt 88 in the thrust direction can be finely adjusted, the force generated in the radial direction can be made constant.

Moreover, since the second taper key 86 is raised by the first taper key 85, it is possible to prevent the adjusting bolt 88 from getting loose by the elasticity of the first and second taper keys 85 and 86. Additionally, a nut may be attached to the end of the adjusting bolt 88 for preventing the bolt 88 from getting loose.

The present invention is not limited to the above-described embodiments. Numerous modifications and variations of the present invention are possible in light of the spirit of the present invention, and they are not excluded from the scope of the present invention.

I claim:

1. An automatic sheet loader for loading a group of sheets into a magazine comprising:

(a) a frame;

(b) sheet transfer means, mounted on said frame and defining a vertical sheet transfer path within said frame, for receiving the group of sheets at an uppermost end of the sheet transfer path and for transferring the group of sheets to a lowermost end of the sheet transfer path;

(c) a magazine section adjacent said lowermost end and containing the magazine;

(d) swing means, pivotally mounted to said frame at the lowermost end of the sheet transfer path, for receiving the group of sheets, in horizontal orientation, from said sheet transfer means, for pivoting the group of sheets into a position oblique to the horizontal and facing the magazine to cause the sheets to drop into the magazine, said swing means including a stopper for temporarily retaining the group of sheets on the swing means, in the oblique position; and (e) a suction device located beneath said magazine for removing the bottom sheet from said group of sheets.

2. An automatic sheet loader according to claim 1, wherein said stopper is swingably supported on said swing means via a shaft, for swinging movement between a hold position for retaining the group of sheets in the oblique position and a release position for releasing and dropping the group of sheets from the oblique position into the magazine.

3. An automatic sheet loader according to claim 2, further comprising a pair of taper keys mounted on said stopper and having opposing slanted surfaces for relative sliding movement between the opposing slanted surfaces between a lock position fixing said stopper to said shaft for rotation with said shaft and an unlock position.

4. An automatic sheet loader according to claim 1, wherein said sheet transfer means comprises:

(a) at least a pair of chains disposed between upper sprockets and lower sprockets so that said pair of chains form the sheet transfer path therebetween;

(b) brackets mounted on both of said pair of chains at predetermined intervals and projecting horizontally into the sheet transfer path for supporting plural groups of sheets, spaced by the intervals, at opposing sides thereof; and (c) drive means for driving said chains so as to move the brackets along said sheet transfer path for transferring the groups of sheets.

5. An automatic sheet loader according to claim 4, further comprising a width adjusting mechanism for moving the chains of said pair toward and away from each other to adjust for a dimension of the group of sheets.

* * * * *